US005595286A

United States Patent [19]

Schulze

[11] Patent Number: 5,595,286

[45] Date of Patent: Jan. 21, 1997

[54] RADIUS ACTUATOR FOR A SAFETY SWITCH

[75] Inventor: Klaus Schulze, Radevormwald, Germany

[73] Assignee: K. A. Schmersal GmbH & Co., Wuppertal, Germany

[21] Appl. No.: 528,142

[22] Filed: Sep. 14, 1995

[30] Foreign Application Priority Data

Sep. 15, 1994 [DE] Germany ..... 44 32 862.1

[51] Int. Cl.[6] ..... H01H 3/04

[52] U.S. Cl. ..... 200/335; 200/329; 200/257; 200/254; 200/260; 439/341; 439/342

[58] Field of Search ..... 200/254, 255, 200/256, 257, 259, 260, 261, 258, 248, 335, 329, 332; 439/341, 342, 246, 247, 248

[56] References Cited

U.S. PATENT DOCUMENTS

| | | | |
|---|---|---|---|
| 1,512,235 | 1/1921 | Perry | 200/248 |
| 1,671,269 | 5/1928 | Bassett | 200/248 |
| 2,082,794 | 6/1937 | Ebert et al. | 200/248 |
| 3,194,934 | 7/1965 | Gauthier | 200/248 |

FOREIGN PATENT DOCUMENTS

| | | | |
|---|---|---|---|
| 3209414 | 9/1983 | Germany | H01H 13/22 |
| 8807681 | 9/1988 | Germany | H01H 27/00 |
| 8807682 | 9/1988 | Germany | H01H 27/00 |

*Primary Examiner*—David J. Walczak
*Attorney, Agent, or Firm*—Chilton, Alix & Van Kirk

[57] ABSTRACT

A radius actuator for a safety switch of the type mounted to a hinged member, such as a flap, lid or the like, having a cover, a holder and a key. The key is pivotally mounted upon the holder such that the key may be rotated about an axis perpendicular to the plane of the pivoting circle of the radius actuator as the hinged member is opened or closed. The key being spring-biased into an insertion position and the pivot angle of the key being adjustable by means of a setscrew received by the holder. The holder being pivotally mounted relative to the cover such that the holder may be rotated about an axis within to a plane of the pivoting circle of the radius actuator as the hinged member is opened or closed. The holder being spring-biased into an insertion position and the pivot angle of the holder being adjustable by means of a setscrew received by the holder.

22 Claims, 3 Drawing Sheets

RADIUS ACTUATOR FOR A SAFETY SWITCH

BACKGROUND OF THE INVENTION

The present invention relates to the actuation of electrical switches and, particularly, to enhancing the utility of radius actuators designed to be mounted on a hinged member for selectively engaging a safety switch. More specifically, this invention is directed to an improved radius actuator having a key pivotally mounted relative to a holder for adjustment of a key pivot angle with a setscrew, wherein the key is spring-pretensioned to an insertion position against the setscrew. Accordingly, the general objects of the present invention are to provide novel and improved methods and apparatus of such character.

DESCRIPTION OF THE PRIOR ART

Radius actuators for safety switches are well known in the art. Such actuators include a switch engaging key mounted on a pivotal holder thus allowing for rotation of the key about one axis.

One such prior art radius actuator, intended for use with a safety switch, is disclosed in German Patent No. DE-U-88 07 682. This known radius actuator employs a holder and a key which is pivotally mounted on the holder. The key rotates about an axis which is perpendicular to the plane of the pivoting circle of the radius actuator. In this prior actuator the key pivot angle can be set with a setscrew and the key is spring-biased into an insertion position against the setscrew. The key is outwardly bevelled on one side and this bevelled region acts as a stop when the key reaches a predetermined maximum key pivot angle. The actuator also incorporates a setscrew with a self-locking thread for adjustment of the key pivot angle. The setscrew is received within a bore which extends through the holder in a direction perpendicular to the axis of rotation of the key and is located beneath the bevelled region of the key. A helical spring is disposed beneath the key so as to be opposite to the bevelled region thereof to counteract the setscrew. The key can, therefore, pivot between a predetermined minimum angle of displacement and a maximum angle of displacement. Furthermore, rotation of the actuator by 180° allows the key to pivot in the opposite direction between a predetermined minimum angle of displacement and a maximum angle. While this prior art radius actuator permits key rotation about an axis perpendicular to the plane of the pivoting circle of the actuator, the key is not capable of pivoting about any other axis. Depending on the placement of the actuator and/or the corresponding safety switch which is engaged by the actuator, key rotation about multiple axes is sometimes either desirable or necessary for proper operation of the safety switch. Thus, the limited adjustability of this prior art radius actuator prevents its application in some circumstances.

A similar prior art radius actuator for engagement with a safety switch is disclosed in German Patent No. DE-U-88 07 681. This radius actuator has a holder and a key which is pivotally mounted to the holder such that the key can be pivoted about an axis in the plane of the pivoting circle of the radius actuator. An axle which extends through the key is received within a stepped bore extending through the holder in a direction perpendicular to the plane of the pivoting circle. In this prior actuator, the pivot angle of the key can be set with a setscrew and the key is spring-biased onto an insertion position against the setscrew. Thus, the key can pivot about an axis in the plane of the pivoting circle between a predetermined minimum angle of displacement and a maximum angle. However, this design is also of limited usefulness because, while this actuator does allow the key to pivot about an axis in the plane of the pivoting circle, it does not allow pivoting about any other axis. As explained above, key rotation about multiple axes is sometime either desirable or necessary for proper engagement of an associated safety switch.

SUMMARY OF THE INVENTION

It is, accordingly, an object of the invention to provide a radius actuator which overcomes the above-mentioned and other deficiencies of the prior art and, in so doing, offers improved adjustability by allowing adjustable pivoting about axes which lie both in the plane of the pivoting circle of the radius actuator and perpendicular to this plane.

It is another object of the invention to provide a radius actuator which is suitable for a greater number of applications than prior art actuators.

It is still another object of the invention to provide such a radius actuator which has an uncomplicated, and thus reliable, design.

These and other objects and advantages are achieved by providing a radius actuator wherein a key holder is mounted relative to a cover so as to be pivotal about an axis which lies in the plane of the pivoting circle of the radius actuator. The holder is spring-biased to an insertion position and the holder pivot angle is capable of being set to an associated insertion position with a setscrew received within the holder. A key is mounted to the holder, so as to be pivotal about an axis which is perpendicular to the plane of the pivoting circle of the radius actuator. The key is spring-biased to an insertion position and the key pivot angle is capable of being set to an associated insertion position with another setscrew received within the holder.

BRIEF DESCRIPTION OF THE DRAWINGS

The invention will be explained in more detail below with reference to the accompanying figures wherein like numerals represent like structures in the several figures, and where.

DETAILED DESCRIPTION OF THE PREFERRED EMBODIMENT

Figure 2:
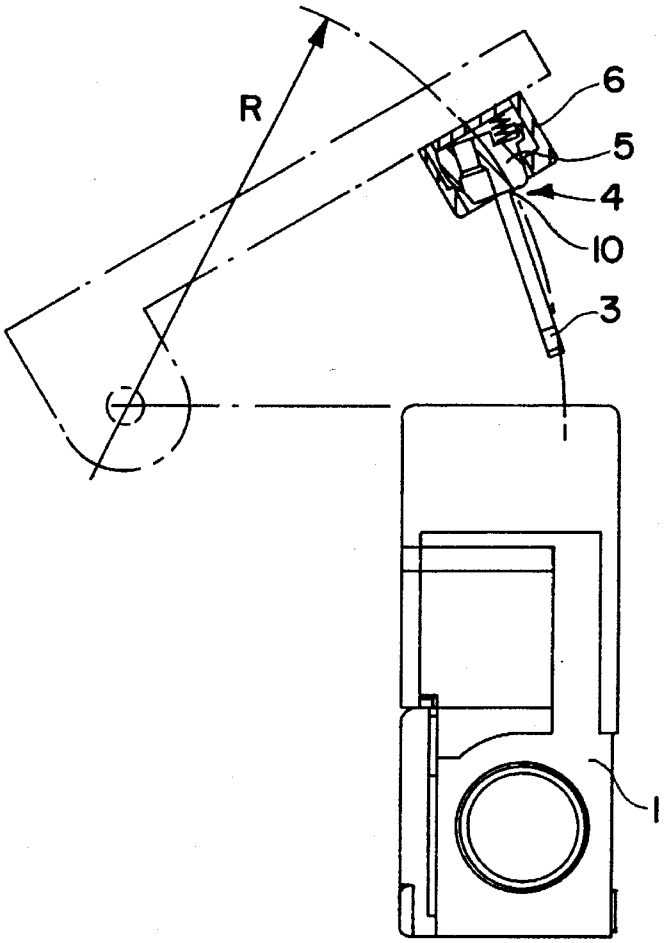
FIG. 2 depicts the radius actuator of FIG. 1 when repositioned by 90° with respect to the hinged member.
Figure 1:
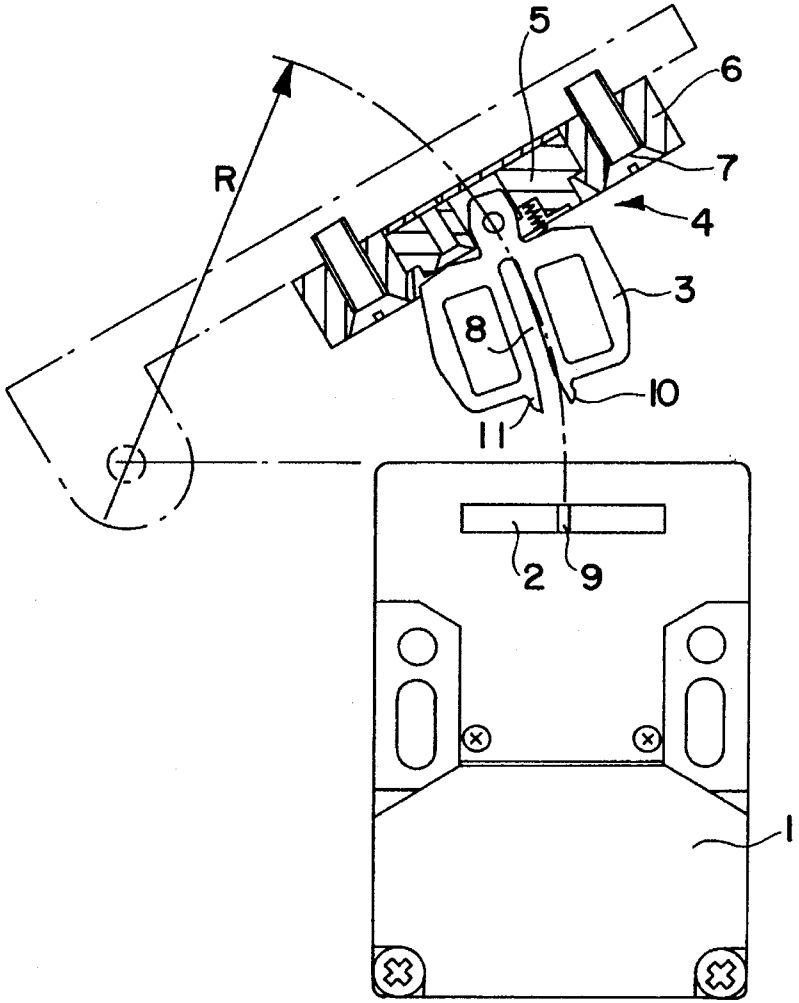
FIG. 1 is a schematic side-elevation view of a radius actuator in accordance with the present invention, the actuator being mounted on a hinged member.
Figure 3:
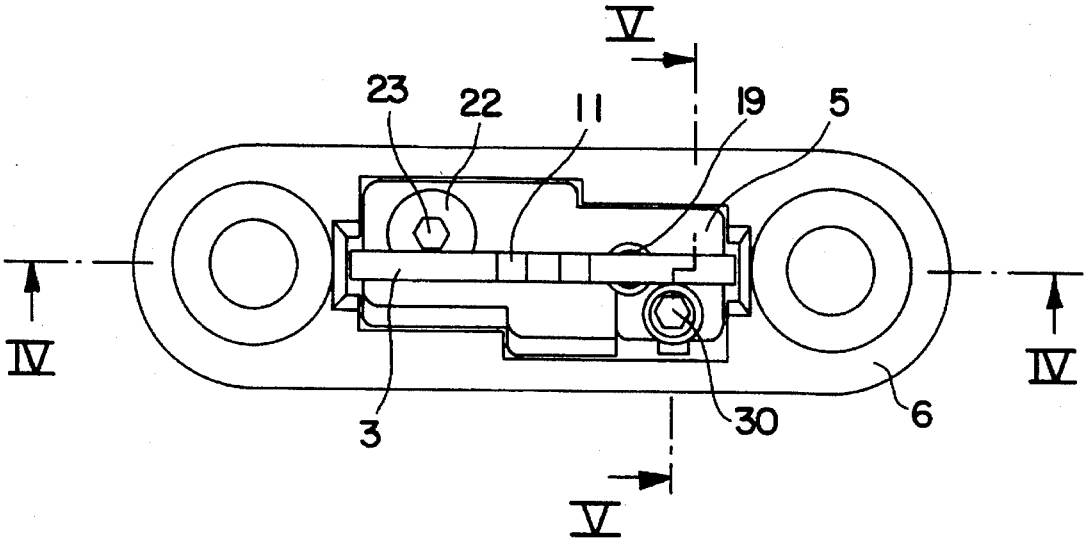
FIG. 3 is a top view of the radius actuator of FIG. 1.

FIGS. 1 and 2 generally show a first embodiment of an actuator, indicated generally at 4, in accordance with the present invention. The actuator 4 is mounted on a hinged member and is aligned for engagement with, and thus actuation of a, safety switch 1. In FIG. 1, the key 3 of radius actuator 4 has been adjusted to an insertion position in preparation for engagement with safety switch 1. In FIG. 2, the radius actuator 4 and the safety switch 1 have both been reoriented, i.e., rotated through an angle of 90°, and the holder 5 of the actuator has been adjusted to place key 3 in alignment with the reoriented safety switch 1.

The safety switch 1 illustrated in FIGS. 1 and 2 possesses an insertion slot 2 for engagement by the flat, symmetrical key 3 of radius actuator 4, key 3 being in the form of a double-U-shackle. Generally speaking, safety switches for use with cooperating keys are well known in the art (see e.g. German patents DE-A-3,100,862, 3,209,414, 3,330,109 and 3,433,048).

In the embodiment depicted in FIGS. 1–4, the radius actuator 4 is mounted on a hinged member such as a flap, lid or the like (represented by broken lines) in such a manner as to center the key 3 at a distance R from the axis of rotation of the hinge. The key holder 5 of actuator 4 is elongated in the plane of key 3 as may be seen by comparing FIGS. 1 and 2. Actuator 4 also has a cover 6 which has a countersunk threaded hole 7 on each of its two sides for receiving the screws which fasten the radius actuator to the hinged member. The holder 5 is received within cover 6.

The key 3 has a centrally located slot 8 for engaging an intermediate wall 9 located within a slot 2 of safety switch 1. Key 3 also has projections 11 which have wedge faces 10 located adjacent to slot 8 and on the side of key 3 which faces away from holder 5. These wedge faces 10 make the initial contact with intermediate wall 9 of safety switch 1 and help guide wall 9 down slot 8 of key 3 as the actuator 4 engages safety switch 1.

Figure 4:
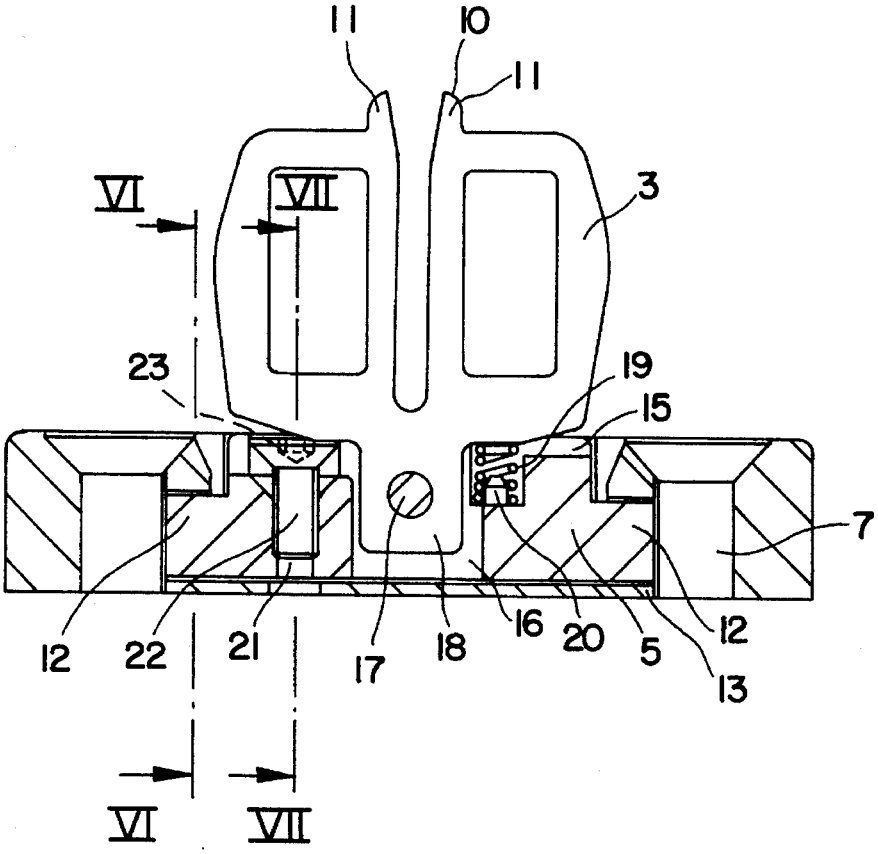
FIG. 4 is a longitudinal section view taken along line IV—IV of FIG. 3.
Figure 6:
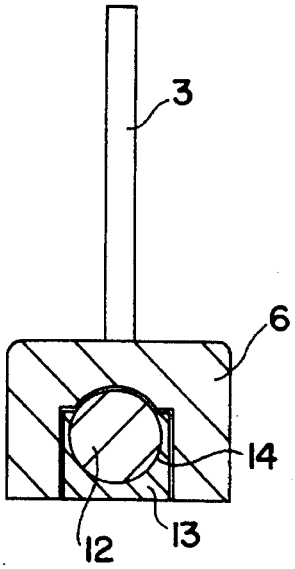
FIG. 6 is a section view taken along line VI—VI of FIG. 4.

As shown in FIG. 4, holder 5 has opposing shaft stubs 12. Stubs 12 are arranged at opposite ends of holder 5 in the plane of key 3. A baseplate 13 affixed to cover 6 has bearing surfaces 14 which engage shaft stubs 12 (see e.g. FIG. 6). Accordingly, holder 5 is rotatable relative to baseplate 13. As illustrated in FIG. 6, bearing surfaces 14 engage shaft stubs 12 of holder 5 over more than 200° in snap-fit fashion. As an alternative, the means for connecting baseplate 13 and holder 5 may comprise interconnectable halves with one interconnectable half being integrally formed with baseplate 13 and the other half either being independent of or integrally formed with cover 6.

The middle part of holder 5, located between shaft stubs 12, has a continuous recess 15 which is in communication with an axial slot 16. Holder 5 is further provided with a bore which receives a pivot axle 17 located on extension 18 of key 3. Pivot axle 17 thus defines an axis, about which key 3 can pivot, oriented perpendicular to the plane of the pivot circle of actuator 4.

As shown in FIG. 4, actuator 4 includes a helical compression spring 19 for spring-biasing key 3 into a tilted insertion orientation. Spring 19 is captured between a shoulder which extends outwardly from slot 16 and the adjacent lower edge of key 3. In the disclosed embodiment, one end of compression spring 19 is engaged by a pin 20.

A bore 21, which receives a countersunk-head setscrew 22, extends through holder 5 in the region of recess 15. The head of setscrew 22 serves as a stop for the adjacent lower edge of key 3. In the embodiment of FIGS. 1–4, bore 21 is threadless and initially polygonal in section, for example, hexagonal. When setscrew 22 is inserted, the threads on setscrew 22 cut into the wall which defines bore 21 in a self-locking manner. As shown, the head of setscrew 22 is offset relative to slot 16 and has a hexagonal socket 23 which is sized and shaped to receive an Allen wrench. Preferably, the head of setscrew 22 is larger than the thickness of key 3, so that setscrew 22 can be adjusted with an Allen wrench without interference with key 3 (see especially FIG. 3). By rotating setscrew 22, the allowable pivot angle of key 3 relative to holder 5 can be set to vary between an insertion position and a switch-actuating position. Corresponding pivot angles in the opposite direction can be achieved by rotating the holder 5 by 180°.

Figure 5:
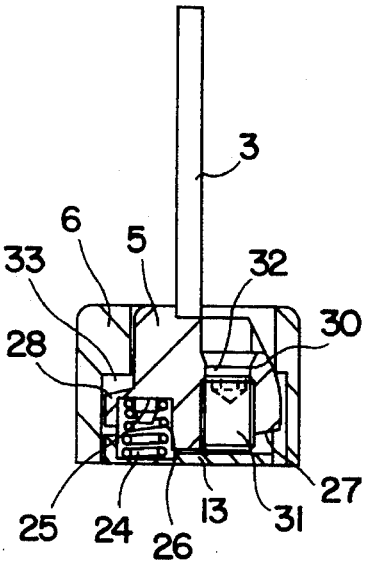
FIG. 5 is a cross-sectional view taken along line V—V of FIG. 3.
Figure 7:
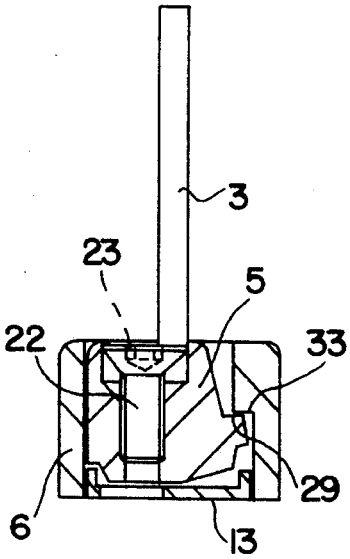
FIG. 7 is a section view taken along line VII—VII of FIG. 4.

As illustrated in FIG. 5, a second helical compression spring 24, for spring-biasing holder 5 into an insertion position, is located in a lateral recess 26 in holder 5 and extends between baseplate 13 and the middle region of holder 5. Recess 26 is on the side of holder 5 which abutts baseplate 13. A pin 25 extends from the bottom of recess 26 for supporting spring 24. The holder 5 pivots relative to the cover 6 about an axis which lies in the plane of the pivot circle of the radius actuator 4 such that key 3 is tilted out its plane (see also FIG. 2). To achieve this pivoting while minimizing the overall height, the bottom of holder 5 is provided with a bevel 27. As shown in FIG. 5, a first projection 28 located on holder 5 limits the maximum pivot angle of holder 5 and, as shown in FIG. 7, a second projection 29 of holder 5 limits the holder pivot angle in the insertion position.

Referring again to FIGS. 2 and 5, setting the holder 5 to the desired insertion position, wherein the plane defined by key 3 is appropriately tilted, is accomplished with a setscrew 31. Setscrew 31 has a hexagonal socket 30 and is received in a self-locking manner by a bore 32 located on the side of holder 5 which faces away from the compression spring 24. Setscrew 31 may be adjusted, with an Allen wrench for example, without being impeded by key 3 (see FIG. 3). The bore 32 can have the same design as bore 21. While the bores 21 and 32 are located approximately diagonal to one another in relation to extension 18 of key 3, compression springs 19 and 24 are located adjacent to one another on the same side of extension 18. The projections 28 and 29 cooperate with internal shoulders 33 on cover 6 which, like bores 21 and 32, are diagonally opposite one another. Tilting of key 3 in a direction opposite to that resulting from rotation of setscrew 31 is achieved by rotating holder 5 together with key 3 by 180°.

Holder 5 may, instead of shaft stubs 12, have corresponding recesses or snap bearings for receiving axle stubs which are either connected to cover 6 or baseplate 13, the stubs defining an axis of rotation for holder 5.

Optionally, baseplate 13 can be removed and, in such case, the hinged member on which radius actuator 4 is mounted will function as a baseplate.

Figure 8:
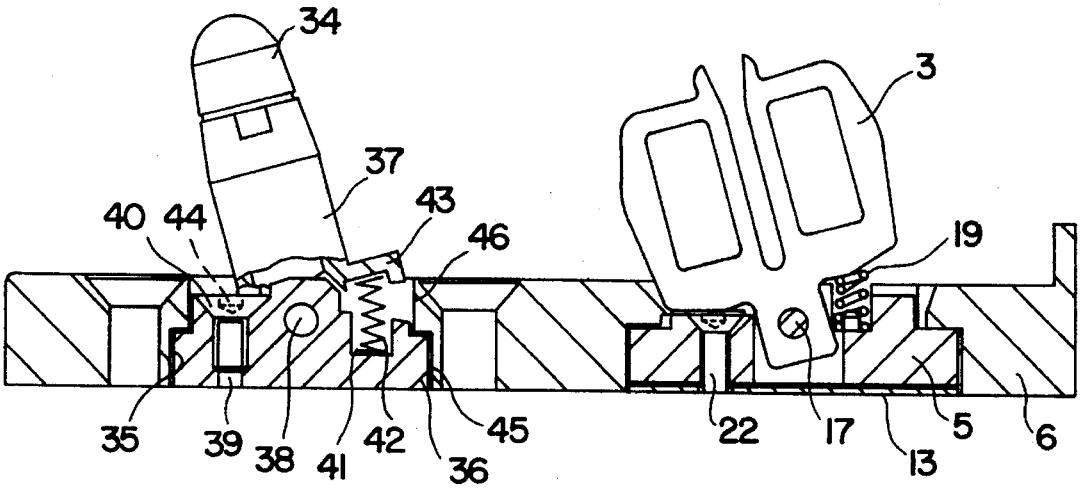
FIG. 8 shows, in longitudinal section, a radius actuator in accordance with the present invention coupled with a locking pin.

FIG. 8 depicts the present invention coupled with a locking pin 34. Locking pin 34 is designed to engage an electromagnet in a manner similar to that described in German patent DE-U-8,717,018. In this arrangement shown in FIG. 8, cover 6 is lengthened (when compared with the embodiments described above) and has an aperture having a lower square portion 35 and an upper round portion 46 for receiving a holder 36 for the locking pin 34. The locking pin 34 is pivotally mounted to a holder 36 by an axle 38 received within holder 36. Holder 36 has a bore 39 for receiving a setscrew 40 and, on the opposite side of axle 38, a bore 41 for receiving a helical compression spring 42. One end of spring 42 bears on a base-side extension 43 of locking pin 34, so that locking pin 34 is spring-biased against setscrew 40. Preferably, setscrew 40 has a hexagonal socket 44 for receiving an Allen wrench and is located in such a way that setscrew 40 can be adjusted without being impeded by locking pin 34. Also, preferably, holder 36 has a square pedestal 45 which is complementary in shape to portion 35 of the aperture in cover 6. The upper portion of holder 36, i.e., the portion which supports axle 38, is generally complementary in shape to portion 46 of the aperture in cover 6. Accordingly, by rotating holder 36 into its four possible positions and by rotating setscrew 40, locking pin 34 can be set to a position in the same general direction as that of key 3.

While a preferred embodiment has been shown and described, various modifications and substitutions may be made thereto without departing from the spirit and scope of the invention. Accordingly, it is to be understood that the present invention has been described by way of illustration and not limitation.

What is claimed:

1. A radius actuator for a safety switch, said actuator being mountable to a pivotal support member for rotation with the support member about a first axis and adapted to be selectively disengaged from and operatively coupled to a safety switch, rotation of the support member about said first axis defining a first plane, said actuator comprising:

(a) cover means adapted to be affixed to the support member for mounting said actuator to the support member;

(b) holder means for supporting a switch engaging key, said holder means including first and second adjustable setscrews and first and second springs, said holder means being pivotally mounted within said cover means such that said holder means may pivot between a first position and a second position about a second axis, said second axis lying within a second plane which is perpendicular to said first plane, said holder means being spring-biased to said first position by said first spring, and an angular displacement between said first and second holder means positions being selected by adjustment of said first setscrew; and (c) key means supported by said holder means, said key means including said switch engaging key and key pivot means for pivotally mounting said switch engaging key on said holder means such that said switch engaging key is pivotal between a pair of angularly displaced positions about an axis which lies in a third plane which is perpendicular to said second plane, said switch engaging key being spring-biased to a first of said angular key positions by said second spring, and an angular displacement between said pair of angularly displaced key positions being selected by adjustment of said second setscrew.

2. A radius actuator as recited in claim 1, further comprising a second holder means for pivotally supporting a locking pin means, said second holder means supporting a third setscrew, a third spring and said locking pin means, said locking pin means being pivotally mounted relative to said second holder means such that said locking pin means is spring-biased to a pin insertion position, and an angular displacement of said locking pin means between a pair of angularly displaced positions being selected by adjustment of said third setscrew.

3. A radius actuator as recited in claim 2, wherein said second holder means includes a square pedestal, and wherein said cover means further comprises means defining a square recess for engagement with said second holder means such that said second holder means can be arranged in four positions relative to said cover means.

4. A radius actuator as recited in claim 1, wherein said cover means further comprises baseplate means for supporting said first setscrew and said first biasing spring.

5. A radius actuator as recited in claim 4 wherein said holder means further comprises first and second stubs, said stubs being aligned at opposing ends of said holder means to define said holder means pivot axis, and said holder means being mounted within said cover means.

6. A radius actuator as recited in claim 5, further comprising a second holder means for pivotally supporting a locking pin means, said second holder means being located within said cover means, said second holder means supporting a third setscrew, a third spring and said locking pin means, said locking pin means being pivotally mounted relative to said second holder means such that said locking pin means is spring-biased to a pin insertion position, and an angular displacement of said locking pin means between a pair of angularly displaced positions being selected by adjustment of said third setscrew.

7. A radius actuator as recited in claim 6, wherein said second holder means includes a square pedestal, and wherein said cover means further comprises means defining a square recess for engagement with said second holder means such that said second holder means can be arranged in four positions relative to said cover means.

8. A radius actuator as recited in claim 5, wherein said baseplate means further comprises first and second bearings means for engaging said first and second stubs in snap fit fashion.

9. A radius actuator as recited in claim 8, further comprising a second holder means for pivotally supporting a locking pin means, said second holder means being located within said cover means, said second holder means supporting a third setscrew, a third spring and said locking pin means, said locking pin means being pivotally mounted relative to said second holder means such that said locking pin means is spring-biased to a pin insertion position, and an angular displacement of said locking pin means between a pair of angularly displaced positions being selected by adjustment of said third setscrew.

10. A radius actuator as recited in claim, 9, wherein said second holder means includes a square pedestal, and wherein said cover means further comprises means defining a square recess for engagement with said second holder means such that said second holder means can be arranged in four positions relative to said cover means.

11. A radius actuator as recited in claim 8, wherein said first setscrew is located near one of said opposing ends of said holder means and said second setscrew is located near the other end of said opposing ends of said holder means.

12. A radius actuator as recited in claim 11, further comprising a second holder means for pivotally supporting a locking pin means, said second holder means being located within said cover means, said second holder means supporting a third setscrew, a third spring and said locking pin means, said locking pin means being pivotally mounted relative to said second holder means such that said locking pin means is spring-biased to a pin insertion position, and an angular displacement of said locking pin means between a pair of angularly displaced positions being selected by adjustment of said third setscrew.

13. A radius actuator as recited in claim 12, wherein said second holder means includes a square pedestal, and wherein said cover means further comprises means defining a square recess for engagement with said second holder means such that said second holder means can be arranged in four positions relative to said cover means.

14. A radius actuator as recited in claim 11, wherein said first and second setscrews further comprise means defining a hexagonal socket for setscrew actuation on one end of each of said first and second setscrews.

15. A radius actuator as recited in claim 14, wherein said holder means further comprises means defining first and second threadless bores for receiving said first and second setscrews, respectively in self-locking fashion.

16. A radius actuator as recited in claim 15, wherein said first and second springs are helical springs, and said holder means further comprises first and second pins to seat said first and second springs.

17. A radius actuator as recited in claim 16, wherein said key pivot means comprises a pivot axle for engagement with said holder means.

18. A radius actuator as recited in claim 17, further comprising a second holder means for pivotally supporting a locking pin means, said second holder means being located within said cover means, said second holder means supporting a third setscrew, a third spring and said locking pin means, said locking pin means being pivotally mounted relative to said second holder means such that said locking pin means is spring-biased to a pin insertion position, and an angular displacement of said locking pin means between a pair of angularly displaced positions being selected by adjustment of said third setscrew.

19. A radius actuator as recited in claim 18, wherein said second holder means includes a square pedestal, and wherein said cover means further comprises means defining a square recess for engagement with said second holder means such that said second holder means can be arranged in four positions relative to said cover means.

20. A radius actuator as recited in claim 17, wherein said pivot axle means is secured by said cover means.

21. A radius actuator for a safety switch, said actuator being mountable to a pivotal support member for rotation with the support member about a first axis and adapted to be selectively disengaged from and operatively coupled to a safety switch, rotation of said support member about said first axis defining a first plane, said actuator comprising:

(a) cover means adapted to be affixed to the support member for mounting said actuator to the support member;

(b) holder means for supporting a switch engaging key, said holder means including first and second adjustable setscrews and first and second springs, said holder means being pivotally mounted within said cover means such that said holder means may pivot between a first position and a second position about a second axis, said second axis lying within said first plane, said holder means being spring-biased to said first position by said first spring, and an angular displacement between said first and second holder means positions being selected by adjustment of said first setscrew; and (c) key means supported by said holder means, said key means including said switch engaging key and key pivot means for pivotally mounting said switch engaging key on said holder means such that said switch engaging key is pivotal between a pair of angularly displaced positions about an axis lying perpendicular to said second axis, said switch engaging key being spring-biased to a first of said angular key positions by said second spring, and an angular displacement between said pair of angularly displaced key positions being selected by adjustment of said second setscrew.

22. A radius actuator for a safety switch, said actuator being mountable to a pivotal support member for rotation with the support member about a first axis and adapted to be selectively disengaged from and operatively coupled to a safety switch, rotation of said support member about said first axis defining a first plane, said actuator comprising:

(a) cover means adapted to be affixed to the support member for mounting said actuator to the support member;

(b) holder means for supporting a switch engaging key, said holder means including first and second adjustable setscrews and first and second springs, said holder means being pivotally mounted within said cover means such that said holder means may pivot between a first position and a second position about a second axis, said second axis lying perpendicular to said first plane, said holder means being spring-biased to said first position by said first spring, and an angular displacement between said first and second holder means positions being selected by adjustment of said first setscrew; and (c) key means supported by said holder means, said key means including said switch engaging key and key pivot means for pivotally mounting said switch engaging key on said holder means such that said switch engaging key is pivotal between a pair of angularly displaced positions about an axis lying perpendicular to said second axis, said switch engaging key being spring-biased to a first of said angular key positions by said second spring, and an angular displacement between said pair of angularly displaced key positions being selected by adjustment of said second setscrew.

* * * * *